US010723152B2

(12) United States Patent
Fromm et al.

(10) Patent No.: US 10,723,152 B2
(45) Date of Patent: Jul. 28, 2020

(54) ELECTRIC FIELD GENERATING TRANSPORT MEMBER

(71) Applicant: Xerox Corporation, Norwalk, CT (US)

(72) Inventors: Paul M. Fromm, Rochester, NY (US); Erwin Ruiz, Rochester, NY (US); Linn C. Hoover, Webster, NY (US); David A. VanKouwenberg, Avon, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 16/050,376

(22) Filed: Jul. 31, 2018

(65) Prior Publication Data

US 2020/0039251 A1 Feb. 6, 2020

(51) Int. Cl.
*B41J 11/00* (2006.01)
*B41J 11/057* (2006.01)

(52) U.S. Cl.
CPC ..... *B41J 11/057* (2013.01); *B41J 11/002* (2013.01)

(58) Field of Classification Search
CPC ... B41J 11/0005; B41J 11/0015; B41J 11/007; B41J 11/005; B41J 2002/16591; B41J 13/08; B41J 13/0027; B41J 15/048; B65G 15/00; G03G 15/00
See application file for complete search history.

(56) References Cited

U.S. PATENT DOCUMENTS 5,771,054 A 6/1998 Dudek et al.
6,652,938 B1 * 11/2003 Nishikawa ..... B65H 5/004 271/18.1
7,216,968 B2 5/2007 Smith et al.
8,840,241 B2 9/2014 Fletcher et al.
2002/0024576 A1 * 2/2002 Numata ..... B41J 11/007 347/105
2002/0071016 A1 * 6/2002 Wotton ..... B41J 11/002 347/102
2006/0164489 A1 7/2006 Vega et al.
2006/0164491 A1 * 7/2006 Sakuma ..... B41J 11/007 347/104
2015/0036155 A1 2/2015 Priebe
(Continued)

FOREIGN PATENT DOCUMENTS

EP 0866381 A1 9/1998

*Primary Examiner* — Scott A Richmond
(74) *Attorney, Agent, or Firm* — Fay Sharpe LLP

(57) ABSTRACT

A printer includes a printhead assembly and a dryer. A transport mechanism conveys the printed media in a downstream direction between the printhead assembly and a dryer and between the dryer and an output device. The transport mechanism includes an electric field-generating transport member. The transport member includes a continuous belt supported by rollers. The belt is driven to transport the printed media on an upper surface of the belt. The belt includes an electrically-insulating inner layer and an electrically-insulating outer layer. First and second sets of electrical conductors are positioned intermediate the inner and outer layers. Electrical conductors in the second set are grounded and alternate with electrical conductors in the first set, A charging unit selectively applies a voltage to only a subset of the electrical conductors in the first set at a time, to electrostatically attract the printed media to the upper surface of the belt.

19 Claims, 9 Drawing Sheets

(56) References Cited

U.S. PATENT DOCUMENTS

| | | | | |
|---|---|---|---|---|
| 2015/0091967 | A1* | 4/2015 | Ueda | B65H 5/004 347/16 |
| 2015/0138288 | A1* | 5/2015 | Chen | B41J 11/002 347/102 |
| 2019/0135565 | A1* | 5/2019 | Kaburagi | B65H 5/085 |

* cited by examiner

ELECTRIC FIELD GENERATING TRANSPORT MEMBER

CROSS-REFERENCE TO RELATED APPLICATIONS

U.S. application Ser. No. 16/050,323, entitled ELECTRIC FIELD GENERATING TRANSPORT MEMBER, filed Jul. 31, 2018, by Paul J. McConville, et al., is incorporated herein in its entirety, by reference.

BACKGROUND

The exemplary embodiment relates to transport devices for print media and finds particular application in connection with a transport member for an inkjet printing system which generates an electrostatic field or other electric field for transporting print media.

Inkjet printing systems generally include a printhead which applies a liquid ink composition from an array of inkjets to form an image on a sheet print media, such as paper. Following deposition of the ink, the image is dried or cured. Aqueous inks are often used which include a significant proportion of water and typically 5-15 weight % of co-solvents with boiling points above 200° C. The water is removed by drying the sheet with airflow and heat or infrared radiation, however, the co-solvents are best left to penetrate into the paper. When coated papers are used with aqueous ink, the co-solvent penetration rates are lower, due to reduced surface porosity. Glossy coated papers can be as low as 3% surface porosity.

Sheets of print media are conveyed through the printer by a sheet transport system, which may include a combination of transport members, such as nip rollers, transport belts, and the like. Problems can occur in the transport system, during drying, depending on the type of transport member used. In the case of nip rollers, these can damage the wet image through contact. Failure to fully dry the image before touching the rollers also causes roll contamination, requiring manual cleaning. Currently, aqueous inkjet systems are designed to dry the image to touch before engaging any nipped drive rollers. In the case of vacuum transport belts, which apply suction to the sheet from below, uneven heating of the sheet can occur. The effects of variation in heating rate and final achieved temperature are particularly noticeable in the image on coated media, which may be evident as a density shift or a gloss shift. Further, vacuum transports have a limited latitude to acquire and hold the sheet leading to the need to reduce the air flows in the dryer oven, especially while the first or last sheet enter or exit the dryer, when most of the transport vacuum holes are uncovered.

There remains a need for a sheet transport system which facilitates drying of the sheets while minimizing these problems, and others.

INCORPORATION BY REFERENCE

The following references, the disclosures of which are incorporated herein by reference in their entireties, are mentioned.

U.S. Pat. No. 7,216,968, issued May 15, 2007, entitled MEDIA ELECTROSTATIC HOLD DOWN AND CONDUCTIVE HEATING ASSEMBLY, by Smith, et al., describes a media hold down and heating assembly of one embodiment of the invention is disclosed that includes a dielectric against which media is positioned, a conductive heating element, and an electrostatic hold down element.

The conductive heating element is to conductively heat the media through the dielectric. The electrostatic hold down element is to electrostatically hold down the media against the dielectric.

U.S. Pat. No. 8,840,241, issued Sep. 23, 2014, entitled SYSTEM AND METHOD FOR ADJUSTING AN ELECTROSTATIC FIELD IN AN INKJET PRINTER, by Fletcher, et al., describes a system and method for adjusting an electrostatic field in a print zone of an inkjet printer. The printer includes an electrostatic tacking device to hold a sheet of recording media to a transport belt moving through the print zone for imaging with one or more inkjet printheads, A sensor determines the electrostatic field before the print zone and adjusts the electrostatic field with a corotron disposed after the tacking device and before the print zone. Reduction of the electrostatic field in the print zone can reduce imaging errors resulting from electrostatic fields.

U.S. Pat. No. 5,771,054, published Jun. 23, 1998, entitled HEATED DRUM FOR INK JET PRINTING, by Dudek, et al., describes an ink jet printing system which utilizes a heated rotary printing drum for mounting and carrying paper to be printed by one or more thermal ink jet printheads to achieve black or full color printing at high speed. Printing and drying are achieved prior to any transfer of the sheet from the drum, reducing smudging of images. Hold down of the sheet onto the drum can be achieved using vacuum or electrostatic forces to precisely retain the sheet on the drum until printing and drying are completed. Heating of the drum can be performed internally or externally.

U.S. Pub. No. 20060164491, published Jul. 27, 2006, entitled STABLY OPERABLE IMAGE-FORMING APPARATUS WITH IMPROVED PAPER CONVEYING AND EJECTING MECHANISM, by Sakuma, et al., describes an image-forming apparatus which includes an endless conveyor belt, a counter roller, and a clutch part. The endless conveyor belt is rotatable to convey paper with a surface of the conveyor belt being charged. The counter roller holds the paper between the conveyor belt and the counter roller and conveys the paper. The clutch part is caused to slip by the difference in velocity between the conveyor belt and the counter roller.

U.S. Pub. No. 20060164489, published Jul. 27, 2006, entitled LATENT INKJET PRINTING, TO AVOID DRYING AND LIQUID-LOADING PROBLEMS, AND PROVIDE SHARPER IMAGING, by Vega, et al., describes forming a charged latent image from ejected liquid on a transfer surface.

U.S. Pub. No. 20150036155, published Feb. 5, 2015, entitled CHARGER PROVIDING NON-UNIFORM ELECTROSTATIC HOLDING FORCE by Priebe, describes a printer transport belt having an electrically non-conducting surface. A charging subsystem is configured to add charge to the transport belt or to a transported sheet to provide an electrostatic holding force. An inking subsystem deposits a pattern of ink on the charged sheet. The charging subsystem provides a non-uniform charge on the sheet, enabling the sheet to expand as a result of ink being deposited by the inking subsystem.

EP Application No. EP0866381, published Sep. 23, 1998, entitled ELECTROSTATIC TRANSPORT SYSTEM FOR TONERED SHEETS, describes an electrostatic transport belt for transporting sheets.

BRIEF DESCRIPTION

In accordance with one aspect of the exemplary embodiment, a printer includes a printhead assembly, which applies an ink composition to print media to form printed media. A dryer, downstream of the printhead assembly, at least partially dries the printed media. A transport mechanism conveys the printed media in a downstream direction between the printhead assembly and a dryer and between the dryer and an output device. The transport mechanism includes an electric field-generating transport member. The transport member includes a continuous belt supported by rollers. The belt is driven to transport the printed media on an upper surface of the belt. The belt includes an electrically-insulating inner layer and an electrically-insulating outer layer. A first set of electrical conductors is positioned intermediate the inner and outer layers. A second set of electrical conductors is positioned intermediate the inner and outer layers. The electrical conductors in the second set are grounded and alternate with electrical conductors in the first set. A charging unit selectively applies a voltage to the electrical conductors in the first set. The charging unit selectively applies a voltage to only a subset of the electrical conductors in the first set, at any given time, to electrostatically attract the printed media to the upper surface of the belt.

In accordance with another aspect of the exemplary embodiment, a method of printing includes applying an ink composition to print media to form wet printed media, at least partially drying the wet printed media, and conveying at least one of the wet printed media and the at least partially dry printed media with an electric field-generating transport member. The transport member includes a continuous belt supported by rollers. The belt is driven to transport the printed media on an upper surface of the belt. The belt includes an electrically-insulating inner layer, an electrically-insulating outer layer, a first set of electrical conductors intermediate the inner and outer layers, and a second set of electrical conductors intermediate the inner and outer layers. The electrical conductors in the second set are grounded and alternate with electrical conductors in the first set. The method further includes selectively applying a voltage to only a subset of the electrical conductors in the first set, at any given time, to electrostatically attract the printed media to the upper surface of the belt.

In accordance with another aspect of the exemplary embodiment, an electric field-generating transport member for conveying a sheet without contacting an upper surface of the sheet is provided. The transport member includes a plurality of rollers, the rollers each being rotated about a respective axis of rotation. A continuous belt is supported by the roller. The belt transports the printed media on an upper surface of the belt. The belt includes an electrically-insulating inner layer, an electrically-insulating outer layer, a first set of electrical conductors intermediate the inner and outer layers, and a second set of electrical conductors intermediate the inner and outer layers. The electrical conductors in the second set are grounded and alternate with electrical conductors in the first set. A charging unit selectively applies a voltage to the electrical conductors in the first set, the charging unit applying a voltage to only a subset of the electrical conductors in the first set at a time to electrostatically attract the printed media to the upper surface of the belt. A platen supplies heat to the sheet through the belt.

DETAILED DESCRIPTION

Figure 1:
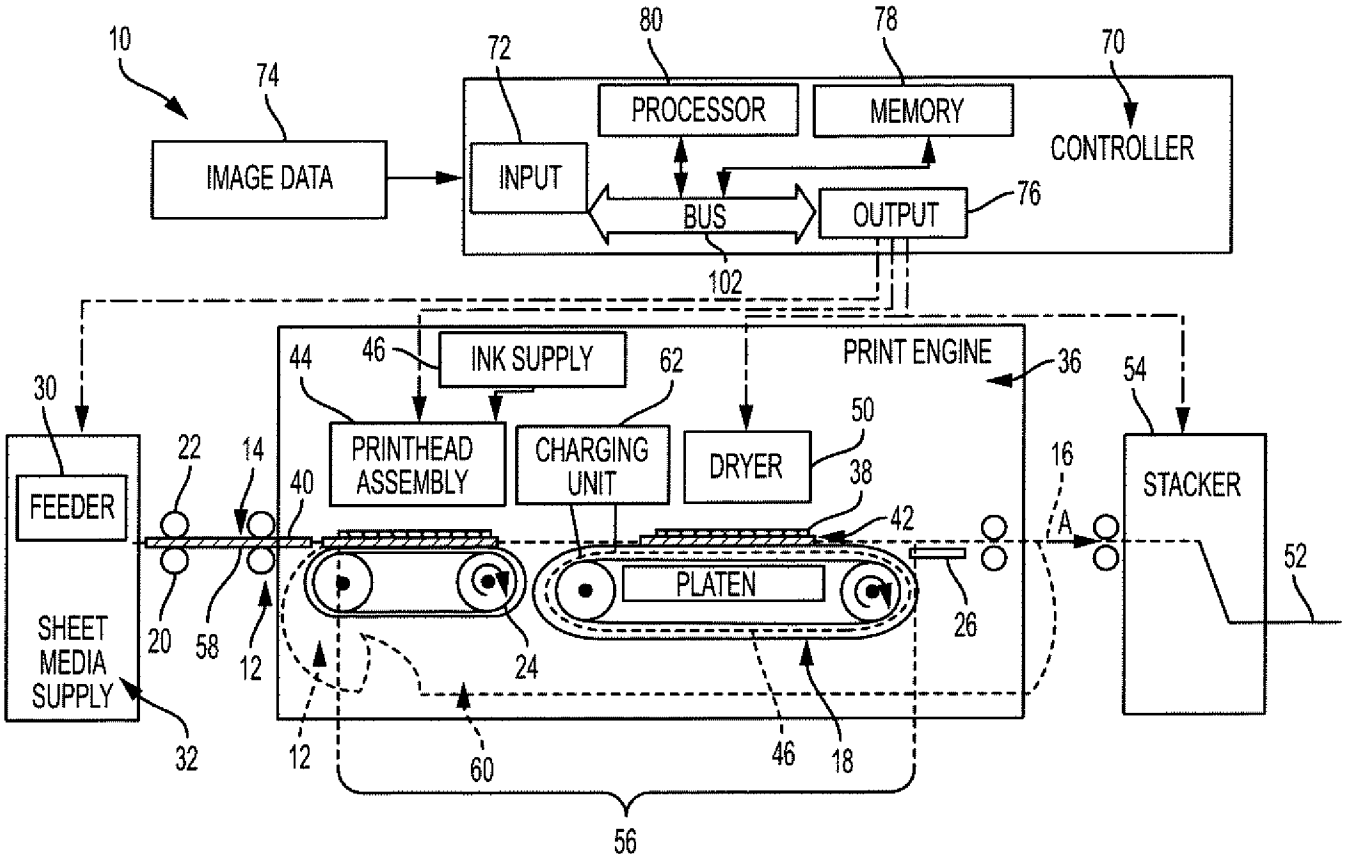
FIG. 1 is a schematic view of a printing apparatus which incorporates an electric field generating transport member in accordance with a first aspect of the exemplary embodiment.

In accordance with one aspect of the exemplary embodiment, a field-generating transport member includes a continuous belt employing electrostatics or varying electric fields to generate a frictional force suitable for transporting a sheet of print media, such as paper. The field-generating transport member is suitable for use in aqueous inkjet systems and avoids the need for nipped drive rollers for transporting a sheet while the sheet is wet with ink.

As used herein, a "printer," or a "printing apparatus" refers to one or more devices used to generate printed media by forming images on print media, using a marking material, such as one or more colored inks or toner particles. The printer may be a digital copier, bookmaking machine, facsimile machine, multi-function machine, or the like, which performs a print outputting function. The print media may be sheets of paper, card, transparencies, parchment, film, fabric, plastic, photo-finishing papers, or other coated or non-coated flexible substrates suitable for printing. The system and method are particularly suited to printing coated sheets, which have lower porosity, and thus longer ink solvent absorption times, than uncoated sheets.

The printer includes a print engine which may incorporate one or more inkjet marking devices, each device including inkjet heads which jet droplets of ink onto the print media, which are then dried or cured, e.g., with heat, air, ultraviolet radiation, or a combination thereof. Other marking devices are also contemplated.

The "process direction" refers to the direction in which a sheet travels along a paper path during the printing process. The "cross-process direction" refers to the direction perpendicular to the process direction, in the plane of the sheet.

While some components of the printer are described herein as modules, this is not intended to imply that they are separately housed from each other and in some embodiments, may be otherwise separated into different housings or contained in a single printer housing.

One advantage of system and method is that printed pages are transported without impacting the image of a print that is not yet fully dried. Another advantage is that nipped drive rollers after the dryer can be omitted to extend the time for the ink to be dry to the touch. Significantly increasing time to the first touch following drying also allows for lower temperatures to be used in the dryer. The exemplary transport member provides a frictional force via electrostatics or varying electric fields that couple to the paper. The external forces can be controlled in geometry by electrode design.

The magnitude of the force can be controlled by the electric field strength, voltage being the easily adjusted parameter for a given set of hardware.

Other advantages include decreased variability of sheet holding pressure, which in turn can result in a lower jam rate. The sheet holding pressure is independent of the total area of media on the transport. The total area of media on the transport changes significantly as the first or last page moves along the transport.

Instead of using a touching roller to generate the normal force of the paper to the drive roller, electrostatic forces are applied from the non-inked side.

With reference to FIG. 1, a printing apparatus 10, such as an inkjet printing apparatus, includes a sheet media transport mechanism 12 which transports sheets 14 of print media, such as paper, plastic, or card, in a downstream direction A along a paper path 16. The transport mechanism 12 includes at least one field-generating transport member 18, as further described below. The transport mechanism 12 may further include conventional transport members, such as drive rollers 20, idler rollers 22, conveyor belts 24, baffles 26, and/or other transport members. A sheet media feeder 30 feeds the sheets 14 singly from a sheet media supply 32 onto the paper path 16.

The transport mechanism 12 conveys the sheets 14 from the sheet media feeder 30 to a print engine 36, which applies an image 38 to an upper surface 40 of each sheet, using a marking material, such as one or more inks, to form printed media 42. The illustrated print engine 36 includes a printhead assembly 44, which includes an array of inkjet nozzles that deposit droplets of one or more ink compositions 46 onto the upper surface 40 of the sheet 14. Each ink composition may be an aqueous ink composition which includes one or more colorants and water. The ink composition may alternatively or additionally include one or more non-aqueous solvents and/or radiation curable (i.e., polymerizable) monomers. For example, 5-15 wt. % of the ink may be non-aqueous solvents with boiling points of at least 80° C., or at least 120° C., such as over 200° C.

The printed sheet 42 is conveyed directly from the printhead assembly 44 to a dryer 50, or other image fixing device (such as a UV curing station), where the wet image 38 is dried, cured and/or otherwise fixed more permanently to the sheet. The dryer 50 applies heat and/or other radiation, such as UV or IR radiation, and/or blowing air, to the printed sheets 42, e.g., from above the sheet. The dryer 50 includes a heat or other radiation source, such as an electric heater and/or light emitting diodes (LEDs), which is controlled to apply sufficient radiation to at least partially dry/cure the image 38. Non-aqueous solvents may remain on the sheet after drying. These cosolvents are allowed to penetrate the sheet while the sheet is transported downstream from the dryer.

In one embodiment, the paper and ink are heated with several infrared carbon lamps to at least 80° C., or at least 90° C., or at least 120° C., such as about 140° C. The drying process also removes moisture from the ink to prevent it from rubbing off. A combination of sensors, thermostats, thermistors, thermopiles, and blowers accurately heat the moving sheets to maintain a rated print speed. Since the time between the entry to the dryer and the first nip can be extended, as compared with a conventional transport mechanism, and additional drying can take place between the dryer and the first nip, the present dryer 50 can operate at a lower temperature than in a conventional printing apparatus.

The printed sheet 42 is conveyed from the dryer 50, along the paper path 16, to a sheet output device 52, such as a tray, optionally via one or more additional components of the printing apparatus, such as one or more additional print engines, a sheet stacker 54, and/or other sheet processing components.

As used herein, the term "downstream direction" or "process direction" refers to movement along the paper path 16 towards the output device 52 and "cross-process direction" refers to a direction orthogonal to the process direction axis in the plane of the paper path 16.

The image 38 remains wet over a portion 56 of the paper path extending from the printhead assembly 44 to the dryer 50 and in some cases, beyond the dryer, particularly in the case of solvent-containing ink compositions 46. In this path portion 56, the printed sheet 42 is conveyed by the field-generating transport member(s) 18. The transport member 18 contacts only a lower surface 58 of the sheet, which is opposite to the recently-inked surface 40, leaving the upper surface uncontacted by a solid member, such as a nip roller, until the sheet is dry to touch. The dried sheet may proceed to the output device 52 or may be returned to the print engine 36 for duplex printing, e.g., via return path 60 including an inverter.

The field-generating transport member 18 applies an electrostatic field or varying electric field to the lower (generally non-inked) surface 58 of the sheet. The field creates a friction force between the sheet and the transport member 18, which is sufficient to enable the transport member to convey the sheet in a downstream direction, without the need to apply a physical force on the sheet from above. As is evident from FIG. 1, there are no nip rollers between the printhead assembly and the dryer for such purposes. One or more charging units 62 supplies electric charge to the field-generating transport member for generating an electric field, e.g., by applying a fixed or alternating voltage.

The operating components of the printing apparatus 10, such as media (sheet) feeder 30, printhead assembly 44, dryer 50, stacker 54, field-generating transport member 18, and other components of the media transport system 12, may be under the control of a controller 70. The controller includes an input device 72, which receives image data 74 for forming one or more images 38 on the sheet media 14, and an output device 76, which outputs control instructions to the operational components of the printing device. Memory 78 stores instructions for operating the printing apparatus, or various operational components thereof, and a processor device 80, in communication with the memory, executes the instructions. The hardware components 72, 76, 78, 80 of the controller 70 may be communicatively connected by a data/control bus 82.

The printhead assembly 44 include inkjets which eject the ink composition(s) onto the media sheets 14. In particular, the assembly 44 includes a supply 46 of ink, in liquid form. The controller 70 modulates the volume of the ink drops ejected by the inkjets of the assembly 44 to form the selected image 38.

The image data 74 generally include information in electronic form that the controller 70 renders and uses to operate the inkjet ejectors in printheads in the printer to compensate for moisture in the ink and to form an ink image on the media sheets. These data can include text, graphics, pictures, and the like. The operation of producing images with colorants on print media, for example, graphics, text, photographs, and the like, is generally referred to herein as printing or marking. The printing apparatus 10 may be a drop-on-demand inkjet printer.

As will be appreciated, the printhead assembly 44 may include two or more inkjet printhead assemblies, each for a respective ink, such as C, M, Y, and K inks. In one embodiment, each printhead assembly may be associated with a respective dryer 50, in which case there may be a respective electrostatic transport member or members 18 for each printhead. In other embodiments, the sheets are not dried between printhead assemblies, and a common dryer 50 may be used. In this embodiment, electrostatic transport member(s) 18 may be positioned, as needed to convey the wet sheets downstream to the dryer.

Figure 2:
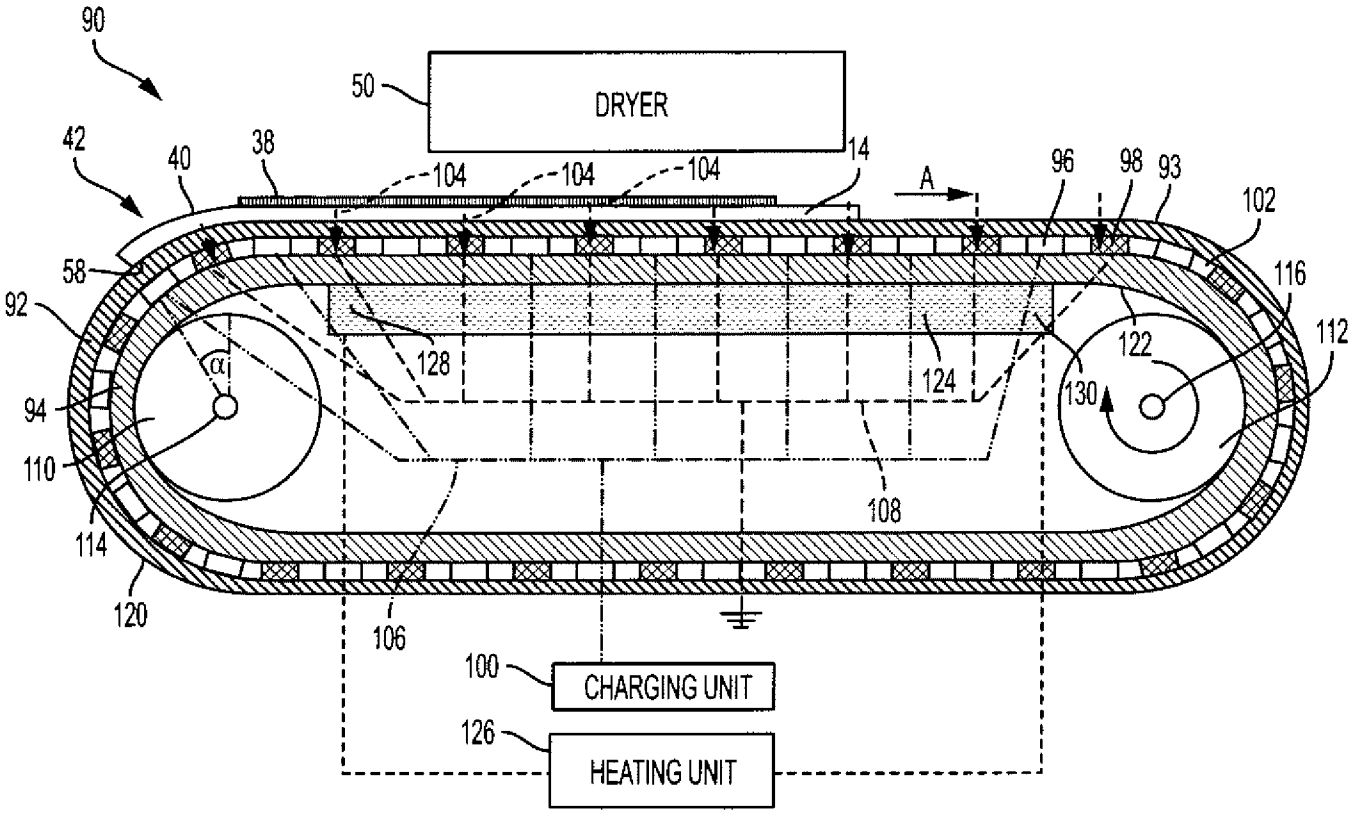
FIG. 2 is an enlarged side-sectional view of the transport member of FIG. 1, in the process direction.
Figure 3:
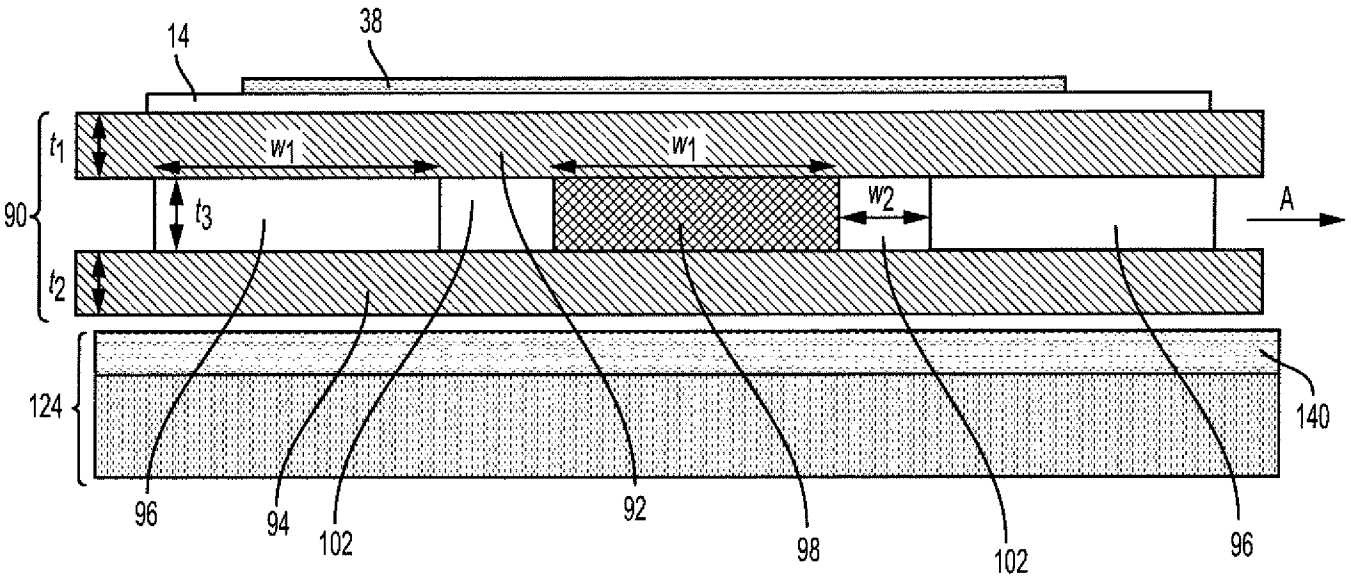
FIG. 3 is an enlarged side-sectional view of part of the transport member of FIG. 2, in the process direction.

With reference now to FIGS. 2-5, the electrostatic transport member 18 includes a continuous belt 90, which has a multilayer configuration, illustrated in enlarged view in FIG. 3. In particular, the belt includes a first layer 92, which is an outer layer of the belt 90. An upper surface 93 of the layer 92 makes contact with the lower surface 58 of the sheet 14. A second layer 94 is an inner layer of the belt. Intermediate the inner and outer layers are sets 96, 98 of interdigitated, spaced conductors including a first set of conductors 96, to which a voltage is applied by a charging unit 100, and a second set of conductors 98, which are grounded and which alternate with the conductors in the first set. The conductors 96, 98 are arranged in parallel with each other, in the cross-process direction, and have a largest dimension in the cross-process direction. Gaps 102 between the conductors 96, 98, etc. are filled with an insulator material. In one embodiment, the belt is seamless. In another embodiment, it has a seam formed by joining ends of a flat triple layer sheet. The number of conductors in the belt may vary, depending on the length of the belt. In one embodiment, there are 5-30 conductors 96, and a corresponding number of conductors 98, per 10 cm length of belt.

Figure 5:
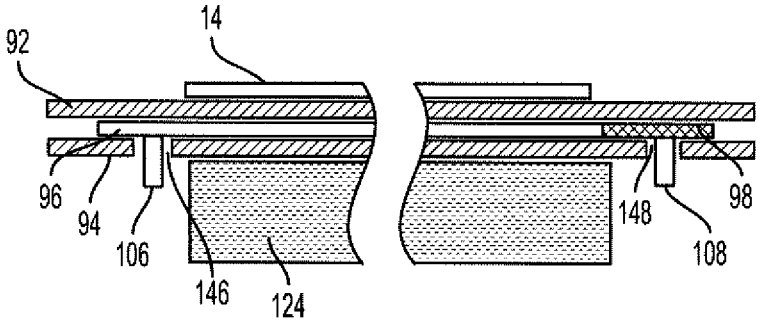
FIG. 5 is an enlarged cross-sectional view of the transport member of FIG. 2, in the cross-process direction, in accordance with one aspect of the exemplary embodiment.

The charging unit 100 supplies a high voltage to the first set of conductors 96, such as at least 500V or at least 1000V. As illustrated in FIG. 2, an electric field 101 generated between the charged conductors 96 and grounded conductors 98 causes the sheet 14 to be attracted to the belt in a paper force zone 104, where a subset of the conductors 96, 98 is currently located. The electrical conductors 96 currently in the region 104, that are charged, are connected to the charging unit by an electrical connector 106. An electrical connector 108 connects the grounded conductors 98 that are in the force zone 104 to ground, as best illustrated in FIG. 5.

Returning to FIG. 2, the belt 90 is supported, on either end, by rollers 110, 112. The rollers are rotated around a respective central axis 114, 116, by a drive mechanism, such as a motor (not shown), which is connected to one or both of the rollers 110, 112. As the rollers 110, 112 are rotated, new conductors 96, 98 enter the paper force zone 104 and provide the attractive force on the sheet 14.

The paper force zone 104 extends along a top surface of the belt 90, causing the sheet to be attracted to the belt slightly before the belt reaches the top of its travel, and then be released from the belt before the belt begins to descend at the downstream end. For example, the angle $\alpha$ to a point on the belt surface, at which a voltage is first applied to a conductor, as measured from a vertical plane at the central axis 114 of the most upstream roller 110, may be from 0° to 60° upstream, or at least 10° upstream therefrom, or at least 20° upstream or up to 45° upstream. This arcuate portion of the belt, which is upstream of the top of the first roller 110, may include at least one or at least two of the charged conductors 96 at any given time.

The belt 90 is free of perforations, i.e., the belt is impermeable to passage of air through the belt between outer and inner surfaces 120, 122 of the belt, at least in the paper force zone 104 on the upper surface 93 of the belt. The outer surface 120 of the belt 90 is essential continuous, thereby providing a uniform heat source or sink to the media in the cross-process direction. This helps to reduce any thermally-induced image disturbance.

An upper portion of the belt 90, intermediate the rollers 110, 112, is supported from below by a platen 124, which remains fixed in position during printing. In the exemplary embodiment, the platen 124 is heated. This may be achieved by applying a voltage across electrical resistors in the platen with a heating unit 126, although other methods of heating the platen are contemplated. In one embodiment, the platen 124 can be both heated and cooled to maintain an optimal elevated temperature. For example, the platen 124 is heated to a higher temperature at a first upstream end 128, which may be upstream of the dryer and then reduced to a lower temperature, e.g., by active cooling or reducing the heating, towards a downstream end 130 of the platen, where more radiant heat is added to the top side 40 of the sheet by the dryer 50. For example, the platen may be segmented into two, three or more zones (e.g., each zone being about ⅙ of the total transport length). The first, upstream zone(s) are maintained at a higher temperature than downstream zone(s) to increase the belt temperature as fast as possible after it has made the return trip under the transport. A thermal fuse assembly may be positioned in the middle, which serves to disconnect electrical power to the thermal elements in the dryer in the case of a thermal out-of-range condition. The platen may be formed from a thermally-conductive material, such as aluminum or other metal. The dimensions of the platen may vary, e.g., a length in the process direction may be 20 cm to 300 cm, and a thickness may be at least 0.5 cm, such as up to 1.5 cm or greater.

The dimensions of the layers 92, 94, conductors 96, 98 and gaps 102 are selected such that a voltage potential between adjacent conductors will induce a charge on the sheet creating pressure to hold the sheet on the transport belt 90. For example, with reference also to FIG. 3, which shows an enlarged cross-sectional view of the belt 90, the outer layer 92 (which contacts the sheet 14) may have a thickness $t_1$ of at least 15 μm, or at least 25 μm, such as up to 200 μm, or up to 175 μm, or up to 150 μm, or up to 100 μm, or up to 50 μm, such as about 25 μm or about 0.1 mm. The inner layer 94 may have a thickness $t_2$ in the same range as $t_1$. In one embodiment, $t_2 \geq t_1$. The two layers are spaced by a distance $t_3$, which corresponds to a thickness of the conductors 96, 98. $t_3$ may be, for example, at least 15 μm, or at least 20 μm, or at least 40 μm, such as up to 1 mm, or up to 0.1 mm, e.g., about 20-60 μm. The conductors 96, 98 may have a width $w_1$ in the process direction, of, for example, at least 0.1 mm, or at least 0.3 mm, or at least 0.5 mm, or at least 1 mm or at least 5 mm, such as up to 20 mm, or up to 15 mm. The insulating gaps 102 between adjacent conductors may have a width $w_2$, in the process direction of, for example, at least 0.2 mm, such as at least 0.5 mm, or up to 20 mm, or up to 15 mm, e.g., 0.5-10 mm. In one embodiment, $w_1 \geq w_2$, e.g., $w_1 \sim w_2$, or $w_1 \geq w_2$, or $w_1 \geq 1.5\ w_2$, or $w_1 \sim 2\ w_2$. The conductors 96, 98 may have a length l, in the cross-process direction (FIG. 4), of at least 10 cm, such as at least 15 cm or at least 20 cm, or up to 1 m, which may depend, in part, on the dimensions of the sheets to be processed. In the exemplary embodiment, the sets of conductors 96, 98 make direct contact with the respective electrical connectors 106, 108, which extend parallel to the process direction. Smaller conductors 96, 98 are generally more suitable as they allow the belt 90 to flex as it travels round the rollers 110, 112.

The inner and outer layers 92, 94 may be formed from an insulating material having a low dielectric constant k. The dielectric constant k is the relative permittivity of a material, relative to a vacuum (or air) and can be determined as the ratio of the capacitance induced by two metallic plates with an insulator between them to the capacitance of the same plates with air or a vacuum between them. As used herein, the dielectric constant k of an insulator is measured at 20° C. and 1 MHz, according to ASTM D150-11, "Standard Test Methods for AC Loss Characteristics and Permittivity (Dielectric Constant) of Solid Electrical Insulation," ASTM International, West Conshohocken, Pa., 2011.

Suitable insulting materials for use as the outer and inner layers 92, 94 of the transport belt have a dielectric constant k of up to 3.9, or up to 3.5, or up to 3.2, or at least 2.5, or at least 2.9, at the thicknesses $t_1$, $t_2$ employed. For example, the layers 92, 94 may comprise or consist of polyimide films, which is available under the trade name Kapton® (k~3.4 for 1 mil (25 μm) Kapton® HN film), or polyethylene terephthalate (PET), which is available under the trade name Mylar® (k~3.1), or a thin silicone impregnated fiber glass. Polyimide is advantageous in a dryer due to its high heat stability.

The alternating conductors 96, 98 may be formed of an electrically-conductive material, such as a metal or alloy which is predominantly copper, silver, nickel, gold, or aluminum, or a combination of electrically-conductive materials.

The gaps 102 may be filled with a high dielectric strength, electrically insulating adhesive, which may be cured after filling the gaps. The adhesive serves to bond the layers 92, 94 together. As used herein, the dielectric strength of the cured adhesive is determined according to ASTM D1304-99(2012), "Standard Test Methods for Adhesives Relative to Their Use as Electrical Insulation," at 20° C. and 60 Hz.

The dielectric strength of the cured adhesive may be at least 15 kV/mm, or at least 17 kV/mm, such as up to 200 kV/mm. Suitable adhesives for filling the gaps are those which cure to form a flexible solid which is able to bend as the belt moves round the rollers. Examples include silicone adhesives, acrylic adhesives, latex adhesives, urethane adhesives and the like. Adequate stability at the high operating temperatures used in a dryer is desirable.

The electric field produced by the charged conductors 96 is sufficient to apply static pressure to the sheet 14, holding it to the belt 90, As the moisture content of the paper is reduced in the dryer 50, the electrical conductivity of the sheet is reduced, causing the static pressure to drop. However, since the paper sheets are not completely dried by the dryer, the static pressure remains significant, for a distance downstream of the dryer.

The electric field also serves to hold the belt 90 in close contact with the platen 124, thereby improving heat transfer between them. The static pressure between the belt 90 in close contact with the platen 124 can be lower than between the belt and the paper. The electric field between the belt and the platen 124 is related to the thickness of the layer 94, between the conductors 96 and the platen and thus the thickness of the layer 94 can be selected to provide a suitable level of contact. To reduce friction between the belt and the platen, the platen 124 may be provided with a film 140 of a low-friction material, such as polytetrafluoethylene (e.g., Teflon®), on top, as illustrated in FIG. 3.

Figure 4:
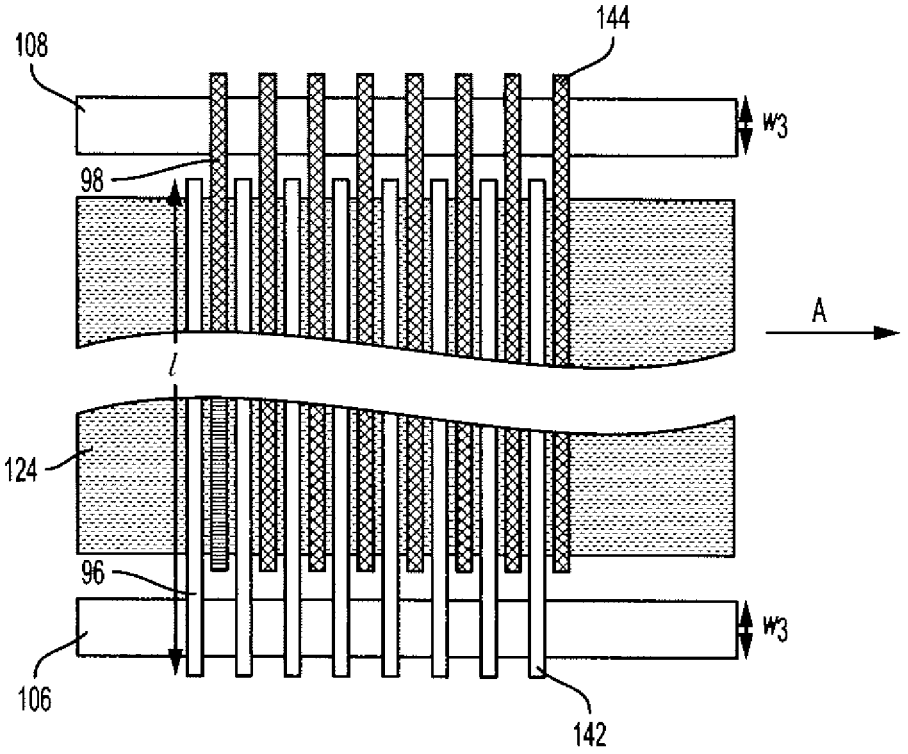
FIG. 4 is a top plan view of part of the transport member of FIG. 2, with upper and lower insulating layers omitted for ease of illustration.
Figure 6:
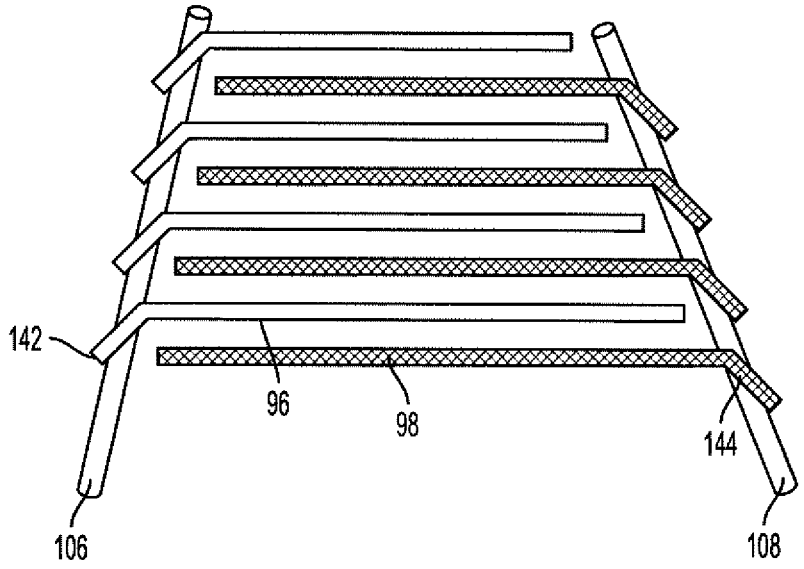
FIG. 6 is an enlarged perspective view of the conductors and contacts of the transport member of FIG. 2, in accordance with one aspect of the exemplary embodiment.

With reference to FIGS. 4 and 5, the electrical contacts 106, 108 may be formed from carbon or other conductive material. In one embodiment, the contacts 106, 108 include bars, which may have a width $w_3$ of from 2-6 mm. In another embodiment, the contacts 106, 108 are carbon brushes with a multiplicity of bristles that make sliding contact with the conductors 96, 98. In another embodiment, a force, such as a magnetic, vacuum, electrostatic, or spring force is used to bias the conductors 96, 98 into contact with the respective electrical contacts 106, 108. For example, leaf springs, foam, felt, a brush, or the like may be positioned at the sides of the upper surface of the belt (avoiding contact with the paper), to push the conductors 96, 98 onto the contacts 106, 108. In another embodiment, a vacuum force may be applied to a lower surface of the belt. In another embodiment, the belt may include a ferrous layer and the contact may be formed of a magnetic material, or vice versa. In another embodiment, respective ends 142, 144 of the conductors 96, 98 may be angled, in the process direction, as illustrated in FIG. 6, to possibly reduce the risk of arcing as the conductors 96, 98 touch contacts 106, 108 by allowing contacts 106, 108 to touch more than one conductors 96, 98 at a time. Combinations of these approaches to improving contact may be employed.

As illustrated in FIG. 5, the lower layer 94 of the belt may define slots 146, 148 through which the respective conductors 96, 98 are exposed. The contacts 106, 108 make electrical contact with the respective conductors 96, 98 through the slots.

Due to the length of the belt 90, the transport member 18 and platen 124 may be divided into foldable sections. The central sections may then be folded, when needed, to shorten the transport member 18 sufficiently to remove it out from its support frame.

Figure 7:
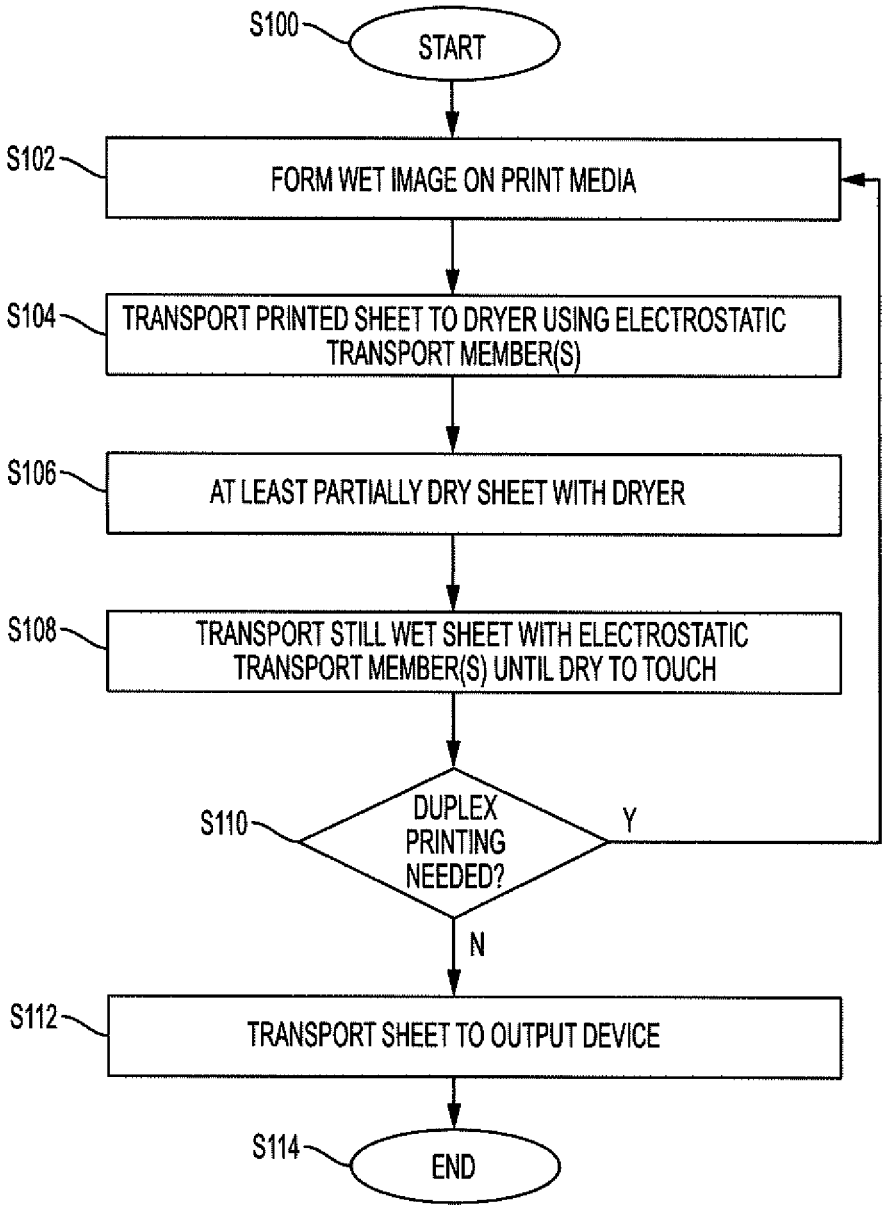
FIG. 7 illustrates a method of printing in accordance with another aspect of the exemplary embodiment.

FIG. 7 illustrates a printing method which can be performed with the apparatus of one or more of FIGS. 1-6. The method begins at S100.

At S102, a wet image 38 is formed on print media by applying droplets of one or more inks to a sheet 14.

At S104, the sheet with the image thereon is transported by a sheet media transport mechanism 12 incorporating one or more transport members 18, as described herein, to a dryer 50. In particular, the transport mechanism 12 conveys the printed media 42 in a downstream direction between the printhead assembly and the dryer without physically contacting the upper surface 40 of the print media or the wet image thereon. A voltage is applied near the top of the entrance roller of the transport to acquire the sheet and the voltage is stopped before the top center of exit roller to release the sheet.

The voltage potential between conductors 96, 98 induces a charge onto the sheet 14 which creates the pressure to hold the sheet to the transport belt 90.

At S106, the printed sheet 42 is dried with the dryer 50, where the wet ink is at least partially dried.

At S108, the sheet 14, with the at least partially dried image 38 thereon, is transported by the sheet media transport mechanism 12, downstream from dryer 50, to a location where the wet ink becomes dry to touch. In particular, the transport member 18, or a second, similarly configured downstream transport member, conveys the printed media in a downstream direction from the dryer without contacting the upper surface of the print media prior to the sheet being dry to the touch.

In some embodiments, at S110, the printed and dried sheet may be returned to the print engine along a return path 60 for printing on the opposite side of the sheet (S102).

At S112, the dry-to-touch printed sheet is transported, directly or indirectly, to a sheet output device 52. At this stage, conventional nip rollers may be used to convey the sheets.

The method ends at S114.

One advantage of the exemplary transport member 18 is that it uses electrostatic forces to hold the sheet 14 to the continuous transport belt 90, which is free from holes and edges, thus producing a more uniform image density and gloss than can be achieved in perforated belts (which use vacuum suction).

Another advantage of omitting a vacuum system is that hot air is not drawn from around the heated platen, which could cause unwanted or uneven cooling.

Another advantage is that fans can be omitted, reducing the printer noise level.

Another advantage is that the force can be applied to the sheet as it reaches the first roller 110. In a vacuum system, it is difficult start vacuum flow very close to the top of the roller. In practice, the vacuum starts or ends at about the vertical tangent to the belt rollers. In contrast, in the present transport member 18, electrical connection to the conductors can be made earlier, partially around the circumference of the belt rollers. On the entrance side this can improve sheet acquisition since forces are exerted on the sheet farther from the air flow that may be exiting the dryer. On the exit side, the force can be broken at an optimum position for helping the sheet strip from the transport belt, while providing an extended length of hold during and after drying, improving the transport robustness. In general, the force is no longer applied at a location no later than top dead center of the roller.

Another advantage is that the electrostatic pressure is not reduced when the transport belt is largely uncovered. Thus, the first leading edge and the last trailing edge of sheets in a print job are as firmly held down as the rest of the sheet edges, thereby reducing variation in the hold-down performance.

Without intending to limit the scope of the exemplary embodiment, the following examples illustrate some of the advantages of the exemplary transport member.

Example

A belt 90 is formed with two polyimide (Kapton®) layers 92, 94, each 25 μm mm thick, spaced by alternating copper conductors 96, 98, each 10 mm wide and 25 μm thick. Gaps 102 between adjacent conductors 96, 98 are 10 mm wide and filled with silicone adhesive (Loctite® Superflex® RTV silicone adhesive sealant).

The polyimide film has a density 1400 Kg/m$^3$, a conductivity of 0.25 W/m/° C., and a specific heat of 1150 J/Kg/° C.

The conductors 96, 98 are formed from copper, which has a density of 8933 Kg/m$^3$, a conductivity of 400 W/m/° C., and a specific heat of 385 J/Kg/° C.

The adhesive has a density 1400 Kg/m$^3$, a conductivity of 0.025 W/m/° C., and a specific heat of 1150 J/Kg/° C.

The paper used in the tests has a density of 0.75 Kg/m$^3$, a conductivity of 0.05 W/m/° C., and a specific heat of 1400 J/Kg/° C.

The belt is heated by an aluminum platen 124, which is about 6 mm thick and about 51 cm long (about ⅙ the distance between the supporting rollers 110, 112) which is heated with an encapsulated resistive heater (Heraeus 2 μm carbon IR emitters or Adphos 0.8 to 1.2 μm near-IR emitters) bonded to the underside, reaching a maximum temperature of 100° C. at its lower surface. The aluminum has a density of 2689 Kg/m$^3$, a conductivity of 237.4 W/m/° C., and a specific heat of 951 J/Kg/° C. Downstream and upstream ends of the platen are insulated.

Contact conductance between the Kapton and Paper and between the Kapton and aluminum is 0.02 W/mm$^2$/° C. The 100° C. temperature of the platen takes about 0.2 sec to propagate through the aluminum.

In one test, the paper is heated with a lamp operating at 800° C., with an emissivity of 1, positioned 4.3 mm from paper, of the same length.

Dryer control parameters (input to the thermal model) were set as follows: Ambient Air 50° C., 0.6 Second, minimum time step 0.0001, Convection of 0.0003 w/mm$^2$/C.

Figure 8:
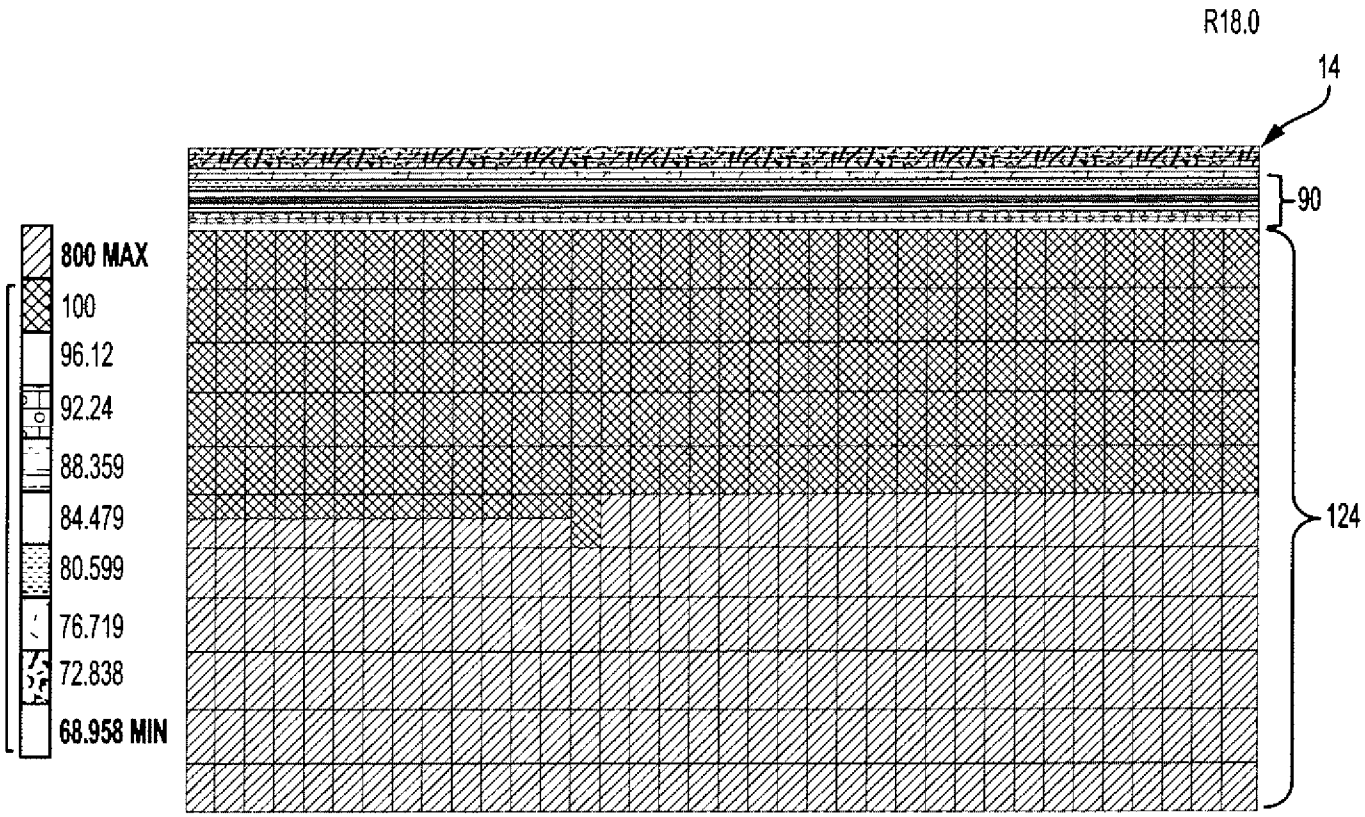
FIG. 8 shows a thermal analysis with heated platen only.
Figure 9:
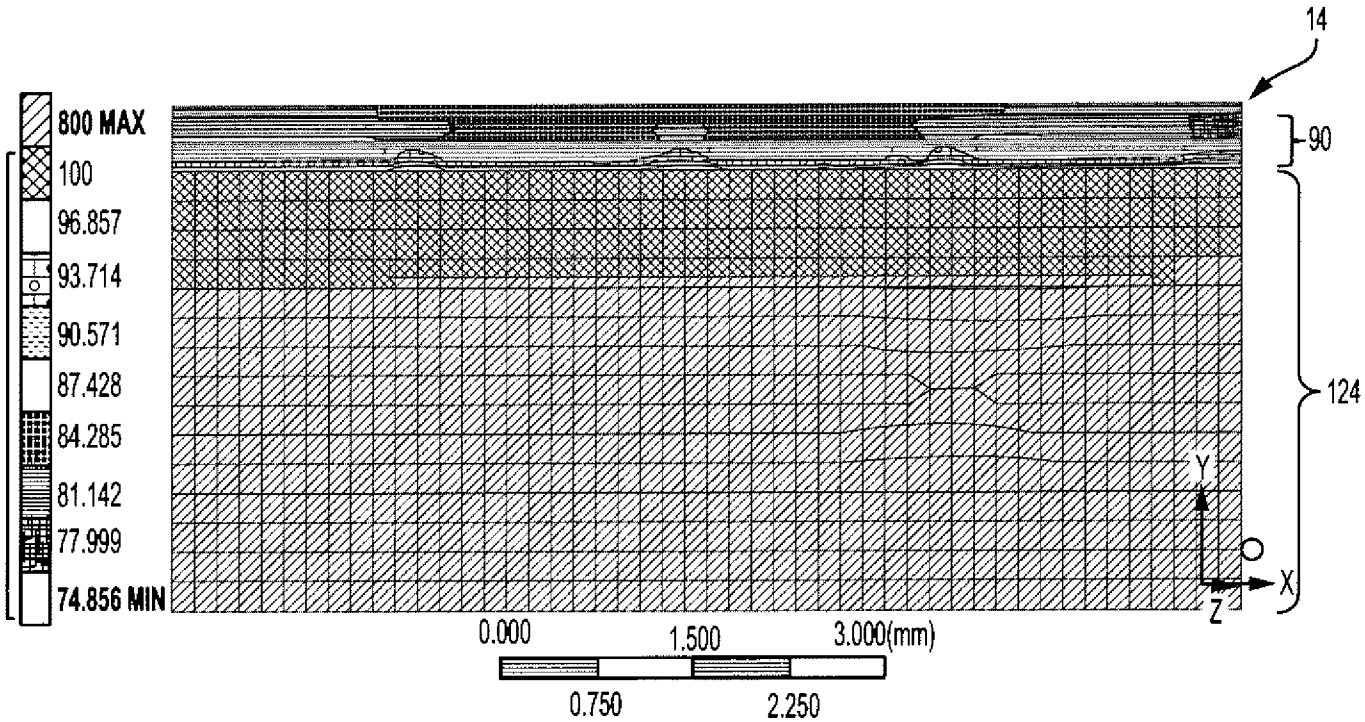
FIG. 9 shows a thermal analysis with heated platen and dryer radiant energy impingement on paper upper surface.

A 2D transient thermal analysis is performed on the belt 90. The belt is initially at room temperature (22° C.) when it reaches the platen. FIGS. 8 and 9 show the results without and with radiant heat from above, respectively. Thermal discontinuities are observed in the belt region, corresponding to differences in thermal conductivity between the copper conductors and the adhesive forming the insulation gaps. However, after conduction through the upper polyimide layer 92 and a sheet of paper 14 that is being radiant heated from above, the difference in temperature between these regions is no more than about 1° C. (FIG. 9). Even without the radiant heat (FIG. 8), the temperature of the top of the sheet is nearly uniform.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A printer comprising:

a printhead assembly which applies an ink composition to print media to form printed media;

a dryer, downstream of the printhead assembly, which at least partially dries the printed media;

a transport mechanism which conveys the printed media in a downstream direction between the printhead assembly and a dryer and between the dryer and an output device, the transport mechanism comprising:

an electric field-generating transport member, which conveys the printed media between the printhead assembly and the dryer, the transport member extending downstream of the dryer and comprising:

a continuous belt supported by rollers, the belt being driven to transport the printed media on an upper surface of the belt, the belt comprising:

an electrically-insulating inner layer, an electrically-insulating outer layer, a first set of electrical conductors intermediate the inner and outer layers, the first set including at least one conductor which is upstream of a top of a most upstream one of the rollers, and a second set of electrical conductors intermediate the inner and outer layers, electrical conductors in the second set being grounded and alternating with electrical conductors in the first set; and a charging unit which selectively applies a voltage to the electrical conductors in the first set, the charging unit selectively applying a voltage to only a subset of the electrical conductors in the first set, which are in a paper force zone, to electrostatically attract the printed media to the upper surface of the belt, the paper force zone extending along the upper surface of the belt, downstream of the dryer.

2. The printer of claim 1, wherein the transport member further comprises a platen, intermediate the rollers, which supports the belt and supplies heat to the printed media through the belt.

3. The printer of claim 1, wherein the transport member extends upstream of the dryer.

4. The printer of claim 1, wherein the outer layer has a thickness of up to 200 μm.

5. The printer of claim 1, wherein the inner and outer layers each have a dielectric constant of up to 3.9, as measured at 20° C. and 1 MHz, according to ASTM D150-11.

6. The printer of claim 1, wherein the inner and outer layers are each formed from a polyimide, polyethylene terephthalate, or a combination thereof.

7. The printer of claim 1, wherein gaps between the conductors are filled with an insulating material.

8. The printer of claim 1, wherein the first set includes at least 10 electrical conductors.

9. The printer of claim 1, wherein the electrical conductors in the first set of conductors each have a width of up to 15 mm.

10. The printer of claim 1, wherein the electrical conductors in the first set of conductors each have a thickness of up to 200 μm.

11. The printer of claim 1, wherein the electrical conductors in the first set of conductors are each spaced from electrical conductors in the second set of conductors by an insulating gap of up to 20 mm.

12. The printer of claim 1, wherein the inner layer defines an inner surface of the belt and the outer layer defines an outer surface of the belt.

13. The printer of claim 1, further comprising a controller which controls the charging unit.

14. The printer of claim 1, wherein the transport member conveys the printed media between the printhead assembly and the dryer, without the printed media being contacted, on its printed surface, by a nip roller.

15. A method of printing with the printer of claim 1, comprising:

applying, by the printhead assembly, an ink composition to print media to form wet printed media;

by the dryer, at least partially drying the wet printed media;

conveying at least one of the wet printed media and the at least partially dry printed media to the dryer with the electric field-generating transport member; and selectively applying, by the charging unit, a voltage to only a subset of the electrical conductors in the first set to electrostatically attract the printed media to the upper surface of the belt.

16. The method of claim 15, wherein the conveying with the at least one electric field-generating transport member is performed without contacting an upper surface of the print media.

17. In a printer with a printhead assembly and a dryer, an electric field-generating transport member for conveying a sheet without contacting an upper surface of the sheet, the transport member comprising:

a plurality of rollers, the rollers each being rotated about a respective axis of rotation;

a continuous belt supported by the rollers, which transports the printed media on an upper surface of the belt, the rollers including an upstream roller and a downstream roller at respective ends of the belt, the belt comprising:

an electrically-insulating inner layer, an electrically-insulating outer layer, a first set of electrical conductors intermediate the inner and outer layers, the first set including at least one conductor which is upstream of a top of a most upstream one of the rollers, and a second set of electrical conductors intermediate the inner and outer layers, electrical conductors in the second set being grounded and alternating with electrical conductors in the first set;

a charging unit which selectively applies a voltage to the electrical conductors in the first set, the charging unit applying a voltage to only a subset of the electrical conductors in the first set at a time to electrostatically attract the printed media to the upper surface of the belt, the subset of the electrical conductors including at least two electrical conductors in an arcuate portion of the belt, which is upstream of a top of the upstream roller; and a platen, intermediate first and second of the rollers, which supplies heat to the sheet through the belt.

18. The printer of claim 2, wherein the platen includes at least two zones, an upstream one of the zones being maintained at a higher temperature than a downstream one of the zones.

19. The printer of claim 1, wherein the electrically-insulating outer layer and the electrically-insulating inner layer are spaced by a distance which corresponds to a thickness of the electrical conductors.

* * * * *